US008210885B2

(12) United States Patent
Rae

(10) Patent No.: US 8,210,885 B2
(45) Date of Patent: Jul. 3, 2012

(54) WATERJET UNIT IMPELLER

(75) Inventor: Philip Andrew Rae, Christchurch (NZ)

(73) Assignee: CWF Hamilton & Co. Limited, Christchurch (NZ)

( * ) Notice: Subject to any disclaimer, the term of this patent is extended or adjusted under 35 U.S.C. 154(b) by 315 days.

(21) Appl. No.: 12/520,342

(22) PCT Filed: Dec. 19, 2007

(86) PCT No.: PCT/NZ2007/000374

§ 371 (c)(1),
(2), (4) Date: Dec. 10, 2009

(87) PCT Pub. No.: WO2008/075981

PCT Pub. Date: Jun. 26, 2008

(65) Prior Publication Data

US 2010/0105260 A1 Apr. 29, 2010

Related U.S. Application Data

(60) Provisional application No. 60/875,801, filed on Dec. 19, 2006.

(51) Int. Cl.
*B63H 11/00* (2006.01)

(52) U.S. Cl. ..... 440/38; 440/50; 416/132 A

(58) Field of Classification Search ..... 440/38, 440/49, 50; 416/147, 205, 132 A
See application file for complete search history.

(56) References Cited

U.S. PATENT DOCUMENTS

| | | | | |
|---|---|---|---|---|
| 3,318,388 | A | 5/1967 | Bihlmire | |
| 3,939,794 | A | 2/1976 | Hull | |
| 4,166,310 | A * | 9/1979 | Rothe et al. | 29/889.7 |
| 5,839,927 | A | 11/1998 | Thomas | |
| 6,422,904 | B1 | 7/2002 | Davies | |
| 6,669,444 | B2 * | 12/2003 | Alacqua et al. | 416/132 A |
| 6,837,760 | B2 * | 1/2005 | Mackey | 440/49 |
| 7,040,940 | B2 * | 5/2006 | Mueller | 440/49 |
| 2003/0220028 | A1 * | 11/2003 | Mackey | 440/50 |
| 2005/0233654 | A1 * | 10/2005 | Mueller | 440/49 |

FOREIGN PATENT DOCUMENTS

| | | |
|---|---|---|
| EP | 0 295 247 | 5/1992 |
| GB | 1 544 916 | 4/1979 |
| SU | 451574 | 11/1974 |
| WO | 87/04400 | 7/1987 |
| WO | 93/09027 | 5/1993 |
| WO | 2004/052721 | 6/2004 |

OTHER PUBLICATIONS

International Search Report dated Apr. 16, 2008 of International Patent Application PCT/NZ2007/000374.

* cited by examiner

*Primary Examiner* — Stephen Avila

(74) *Attorney, Agent, or Firm* — Dann, Dorfman, Herrell and Skillman, P.C.

(57) ABSTRACT

A variable rating impeller (10) for the pump of a waterjet unit that is rotatably driven by an engine to generate a high velocity jet stream. The impeller (10) having a hub (12) mountable to a rotating shaft through which an input power is transmitted by the engine, and a plurality of blades (18) spaced about the periphery of the hub. The blades (18) have a primary profile that defines the primary rating of the impeller, and a trailing portion (28) of each blade has resilient flexibility relative to the primary profile such that the trailing portion will progressively flex under hydrodynamic load to alter the profile of the blades to progressively lower the rating of the impeller (10) with increase in engine speed.

24 Claims, 3 Drawing Sheets

WATERJET UNIT IMPELLER

CROSS REFERENCE TO RELATED APPLICATION

This application claims the benefit of U.S. Provisional Application No. 60/875,801, filed Dec. 19, 2006.

FIELD OF THE INVENTION

The present invention relates to an impeller for a waterjet propulsion unit. In particular, although not exclusively, the impeller is for waterjet propulsion units that propel marine vessels.

BACKGROUND TO THE INVENTION

Waterjet propulsion systems are now in widespread use in high speed marine vessels, which are generally defined as those designed to cruise at speeds above 25 knots. A waterjet is essentially a pump that ingests water from underneath the rear of the vessel via a flush mounted intake, and then discharges it at high velocity via a nozzle at the rear of the unit. The reaction to the discharge of this high velocity jet stream provides the thrust to propel the vessel. The power to drive the waterjet pump is typically provided by a gasoline or diesel engine, and in some cases a gas turbine.

Waterjets offer many advantages over conventional propellers and one of particular relevance is the fact that the power absorbed by the waterjet pump is not affected by the speed of the vessel, as is the case with a propeller. With a conventional fixed pitch propeller, the pitch (typically defined as the distance the propeller will progress through the water in one revolution, ignoring slippage) is selected based on the power and rpm of the engine, and the boat speed.

Regardless of the propulsion system type, vessel speed is a function of the load on the vessel and the total power input. With a fixed-pitch propeller that "screws" through the water, if the load increases (for example, with more passengers or cargo on board) and the engine throttle setting and thus power remains constant, the vessel speed drops and the speed of the propeller and engine reduces. This condition results in a higher engine loading. If the vessel load decreases and the engine power remains constant, the vessel speed increases and the speed of the propeller and engine increases. With a diesel engine, this results in the engine over-speeding and a governor will begin to act to restrict this over-speed by reducing the power, thereby limiting the maximum speed at which the vessel may travel at a reduced load.

With a waterjet, the engine cannot be overloaded as the vessel load increases, and similarly cannot over-speed as the vessel load decreases, as the waterjet power absorption characteristic is essentially independent of vessel speed. The waterjet can therefore work efficiently across a broader operating speed range than a propeller.

On a waterjet propelled vessel, a pump impeller must be selected that will absorb the full power of the engine at its rated rpm (revolutions per minute). For example, a typical small diesel engine might deliver 270 kW at 3000 rpm. For a given impeller type, the waterjet power absorption is proportional to the rpm cubed, as follows: $P=R\times rpm^3$, where P=the power absorbed at a specified rpm, and R=the impeller rating. For example, if a waterjet is fitted with an impeller that is designed to absorb 10 kilowatts (kW) at 1000 rpm, then at 2000 rpm it will absorb $10\times(2000/1000)^3=80$ kW.

The waterjet power absorption characteristic, being a function of $rpm^3$ and independent of vessel speed, also presents a disadvantage versus propellers. For example, take two identical vessels of the same displacement (weight), engine power and design speed—one fitted with waterjets and the other fitted with propellers. When the vessels are "cruising" at a speed below the maximum speed, the rpm of the propeller will be lower than that of the waterjet due to the aforementioned characteristics of both propulsion systems, even if the engine power being delivered is similar. The waterjet is often perceived to be less efficient due to its higher operating rpm at a particular cruise speed. The higher rpm of the waterjet at cruise may also result in slightly higher noise levels.

By way of example, the graph in FIG. 1 further illustrates the difference between propeller and waterjet propulsion systems with respect to vessel speed versus engine rpm characteristics. FIG. 1 shows the vessel speed versus engine rpm for two identical vessels (36' Express Cruiser) with the same engine power (twin 440 hp engines), one with waterjets, the other with propellers. As the waterjet is more efficient than the propeller at higher speeds, the waterjet equipped vessel achieves 40 knots, versus 38 knots for the propeller equipped vessel. If these vessels were both cruising at 32 knots, the engines driving the waterjets would be turning at around 2750 rpm, whereas the engines driving the propellers would be turning at around 2550 rpm, which is 200 rpm lower. As the efficiency of the propeller and waterjet is similar at this vessel speed, the engine power delivered in each case would be similar.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide an improved impeller for the pump of a waterjet unit that enables the waterjet unit to operate at an engine speed closer to that of a conventional propeller over a particular vessel speed range, or to at least provide the public with a useful choice.

SUMMARY OF THE INVENTION

In a first aspect, the present invention broadly consists in an impeller for the pump of a waterjet unit that is rotatably driven by an engine to generate a high velocity jet stream, having a thrust that is dependent on the power absorbed by the impeller, which is in turn dependent on the rating of the impeller and the engine speed, to propel a marine vessel, the impeller comprising: a hub mountable to a rotating shaft through which an input power is transmitted by the engine; and a plurality of blades spaced about the periphery of the hub, the blades having a primary profile that defines the primary rating of the impeller, each blade having a span that extends outwardly from the hub to an outer edge of the blade and a length defined between a leading edge of the blade situated toward the front end of the hub and a trailing edge of the blade situated toward the rear end of the hub, where a trailing portion of each blade has resilient flexibility relative to the primary profile such that the trailing portion will progressively flex under hydrodynamic load to alter the profile of the blades to progressively lower the rating of the impeller with increase in engine speed.

Preferably, the trailing portions of the impeller blades are arranged to progressively flex under hydrodynamic load to alter the profile of the blades to progressively lower the rating of the impeller from the primary rating with an increase in engine speed, and then arranged to progressively increase the rating of the impeller back toward the primary rating as the engine speed decreases.

Preferably, the flexible trailing portion of each blade extends approximately ⅓ or less of the length of the blade from the trailing edge.

Preferably, the flexible trailing portion of each blade is arranged to flex toward a shallower profile relative to its primary profile to progressively lower the rating of the impeller with increase in engine speed.

Preferably, the flexible trailing portion of each blade have a degree of flex that is proportional to the engine speed squared such that increasing engine speed causes a progressively increasing degree of flex on the trailing portions.

Preferably, the flexible trailing portion of each blade has minimal or negligible progressive flex for a substantial portion of the lower engine speed range to maintain the primary rating of the impeller, and increasing substantial progressive flex for an upper portion of the engine speed range to progressively lower the rating of the impeller from its primary rating.

Preferably, the flexible trailing portion of each blade is arranged to progressively flex from the primary profile to a maximum deflection angle in the upper portion of the engine speed range, the angle of deflection increasing at an increasing rate toward the maximum engine speed.

Preferably, the primary profile of the blades is steeper than the conventional profile selected for the engine such that the impeller has a higher than conventional rating when the blades are resting in their primary profile.

Preferably, the number of blades spaced about the periphery of the hub ranges between four and six.

Preferably, the flexible trailing portion of each blade is of a reduced thickness relative to remainder of the blade to provide for flex under hydrodynamic loads.

In one form, the blades are formed entirely from one type of material. In another form, the blades are formed from a plurality of non-homogenous materials and wherein the flexible trailing portion of each blade is formed from a different material relative to the remainder of the blade to provide for flexibility under hydrodynamic loads.

In one form, each blade and its respective trailing portion is integrally formed as one component. In another form, the flexible trailing portion of each blade is separately formed and attached to the remainder of its respective blade.

Preferably, the blades are formed form a material selected from plastic or metal or any combination of these materials.

Preferably, the primary profile of the blades, provide a primary rating of the impeller that is higher than the conventional selected rating of the impeller for the engine to reduce the engine speed required compared to the conventional across a substantial portion of the vessel speed range demanded.

In a second aspect, the present invention broadly consists in a waterjet unit for propelling a marine vessel comprising: a pump having an intake for water; an impeller for the pump that is rotatably driven by an engine to generate a high velocity jet stream from the intake water, the high velocity jet stream having a thrust that is dependent on the power absorbed by the impeller, which is in turn dependent on the rating of the impeller and the engine speed, to propel the marine vessel, the impeller comprising: a hub mountable to a rotating shaft through which an input power is transmitted by the engine; and a plurality of blades spaced about the periphery of the hub, the blades having a primary profile that defines the primary rating of the impeller, each blade having a span that extends outwardly from the hub to an outer edge of the blade and a length defined between a leading edge of the blade situated toward the front end of the hub and a trailing edge of the blade situated toward the rear end of the hub, where a trailing portion of each blade has resilient flexibility relative to the primary profile such that the trailing portion will progressively flex under hydrodynamic load to alter the profile of the blades to progressively lower the rating of the impeller with increase in engine speed.

In a third aspect, the present invention broadly consists in a variable rating impeller for the pump of a waterjet unit that is rotatably driven by an engine to generate a high velocity jet stream, having a thrust that is dependent on the power absorbed by the impeller, which is in turn dependent on the rating of the impeller and the engine speed, to propel a marine vessel, the impeller comprising: a hub mountable to a rotating shaft through which an input power is transmitted by the engine; and a plurality of blades spaced about the periphery of the hub, the blades having a primary profile that provides a higher-than-conventional impeller primary rating for the engine, each blade having a span that extends outwardly from the hub to an outer edge of the blade and a length defined between a leading edge of the blade situated toward the front end of the hub and a trailing edge of the blade situated toward the rear end of the hub, where a trailing portion of each blade has resilient flexibility relative to the primary profile such that the trailing portion will progressively flex under hydrodynamic load to alter the profile of the blades to progressively lower the rating of the impeller with increase in engine speed, the degree of flex being minimal over a substantial lower portion of the engine speed range to provide a higher vessel speed in response to the engine speed relative to the conventional engine speed required by virtue of the higher-than-conventional impeller primary rating, and the degree of flex increasing substantially to lower the impeller rating as engine speed increases into an upper portion of the engine speed range to ensure the engine is not overloaded at higher engine speeds.

In this specification, the term "rating" relates to the power absorbed by the impeller at a given speed of rotation, wherein the rating is defined predominantly by the profile of the blades of the impeller.

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

The invention consists in the foregoing and also envisages constructions of which the following gives examples only.

BRIEF DESCRIPTION OF THE DRAWINGS

A preferred embodiment of the invention will be described by way of example only and with reference to the drawings, in which.

DETAILED DESCRIPTION OF A PREFERRED EMBODIMENT

Figure 2:
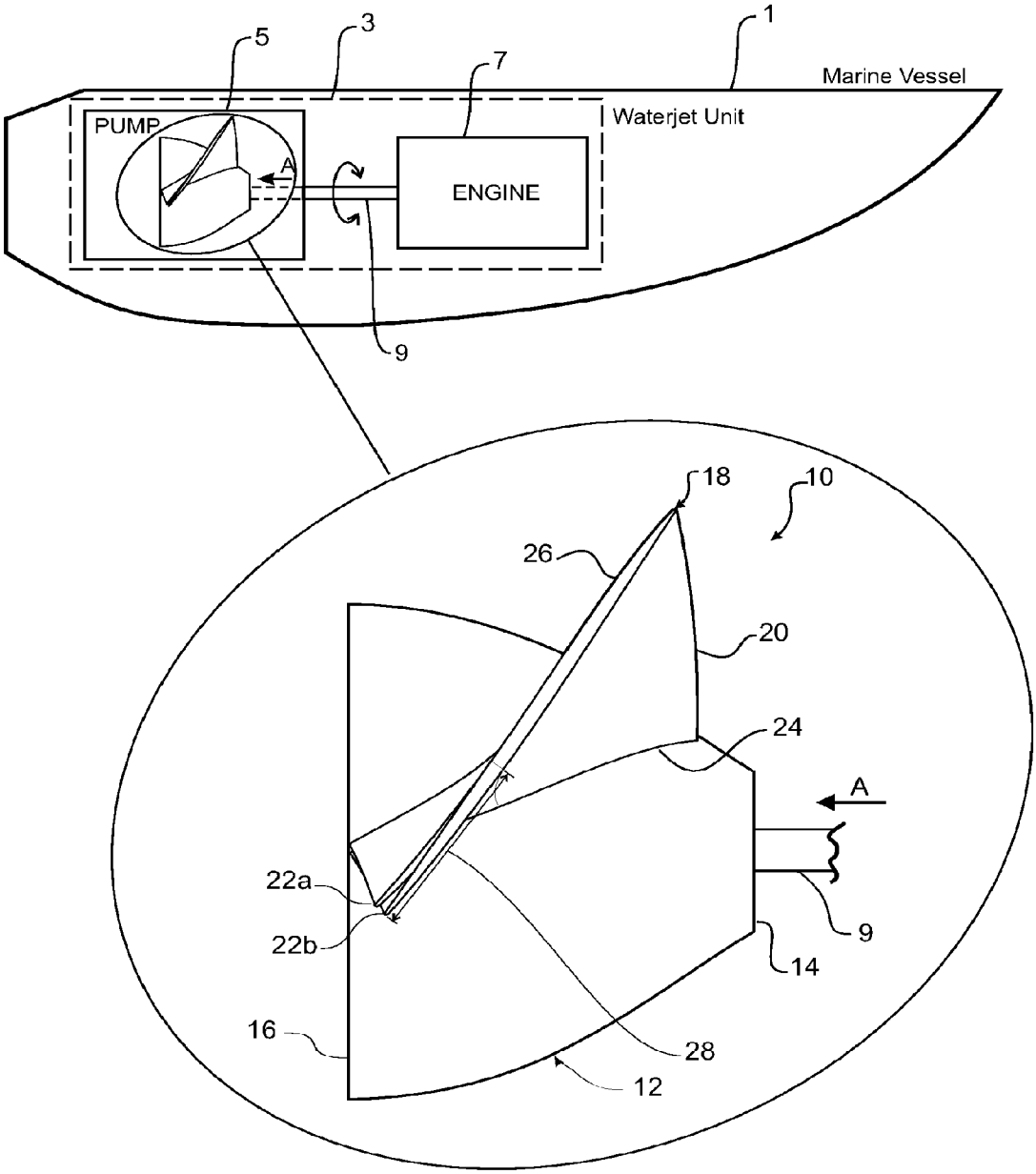
FIG. 2 is a schematic drawing of a marine vessel including a waterjet unit having a preferred form of the impeller (shown in close-up side view) of the present invention.

Referring to FIG. 2, the present invention relates to a variable rating impeller 10 for the pump 5 of a waterjet unit 3 of a marine vessel 1 that is capable of lowering the engine speed (rpm) required to propel the marine vessel in the vessel speed range below its maximum speed. In particular, the impeller is arranged to have a higher primary rating than would ordinarily be selected for a particular waterjet unit engine but which is also arranged to automatically reduce its rating progressively as engine speed increases to prevent the pump of the waterjet from overloading the engine. As the power absorbed by the waterjet pump is proportional to $rpm^3$, at higher engine speeds the power increases at a higher rate than at lower speeds. As the rating (R) of the impeller progressively decreases with increase in engine speed, the power absorbed is limited to that provided by the engine at its maximum operating rpm.

By way of example, the impeller 10 comprises a hub 12 that increases progressively in diameter from the front 14 to the rear 16. The hub 12 of the impeller 10 is mounted to a rotating shaft 9 driven by the engine 7 of the waterjet unit 3. A plurality of blades 18 (only one shown for clarity) are spaced about the hub 12. Preferably, there are four to six impeller blades. Each blade 18 has a length defined between a leading edge 20 toward the front 14 of the hub 12 and a trailing edge 22*a* toward the rear 16 of the hub. Each blade 18 also has a span between the hub edge 24 and outer edge 26 of each blade. Each blade 18 is arranged with a resiliently flexible trailing portion 28 that is arranged to progressively flex or bend under hydrodynamic loading toward a shallower angle 22*b* as the speed of rotation of the impeller 10 increases to progressively lower the rating of the impeller to prevent it from overloading the engine. In particular, the impeller rating is required to reduce with increasing rpm and the increased hydrodynamic loads on the impeller are utilized to act on the blades so as to reduce the blade angle and hence the impeller rating.

The deflection of the resilient flexible trailing portions of the blades from their rest position in the primary profile is dependent on the blade loading, which is in turn dependent on the torque delivered to the impeller. There will be no deflection from the primary profile of the blades when the impeller is at rest and also minimal or negligible deflection when the impeller is rotating at an engine idle speed. However, as the engine speed increases from idle toward maximum the deflection of the trailing portions of the blades will progressively increase at an increasing rate to progressively lower the impeller rating to control the power absorbed to avoid engine overload.

The primary (or resting) profile of the blades 18 in which the trailing portion 28 is resting in position 22*a* determines the primary rating of the impeller. The angle of the primary profile of the blades 18 is steeper than what would conventionally be selected for a particular engine specification such that the rating is also higher than conventional. In operation, the blades substantially maintain their primary profile for a substantial lower portion of the engine speed range such that the higher rating of the impeller 10 reduces the conventional engine speed required for a particular marine vessel speed demanded. However, the trailing portions 28 of the blades 18 begin to progressively flex into a shallower profile at 22*b* to lower the rating of the impeller to prevent engine overload as the vessel speed demanded increases toward maximum causing the engine speed to increase.

By way of example, the flexible trailing portion or section of each blade 18 comprises approximately one-third, or less, of the length of the blade from the trailing edge 22*a*.

The impeller, including the blades and hub, may be formed from a homogenous material such as plastic composites or metal or any other appropriate material or combination thereof. The flexible trailing portion 28 may be of reduced thickness compared to the remainder of the blade to provide for bend or flex under hydrodynamic load. Further, the blades need not necessarily be homogeneously formed from one material and the trailing portion of the blades may be formed from a more flexible material. Each blade, including its trailing portion, may be an integral component but it will be appreciated that the flexible trailing portion or section of the blade need not necessarily be preformed with the remainder of the blade and it may be attached to the blade as a separate component.

In operation, water flows onto the front end of the impeller in the direction of arrow A and the pressure of the flow increases through the impeller blade passages towards the rear end 16 of the hub. As the flex of the trailing portions of the blades is proportional to torque, a significant degree of flex occurs in an upper portion of the engine speed range as the degree of flex progressively increases at an increasing rate with increase in rotational speed of the impeller, and vice versa as the rotational speed reduces and the impeller returns to its resting primary rating.

The upper portion of the engine speed range in which the flex due to hydrodynamic loading is most significant will depend on the flexibility of the trailing portions of the blades. It will be appreciated that the degree of resilient flexibility of the trailing portions of the blades may be selected to accord with the desired rate at which the impeller rating is to progressively vary (reduce) from the primary rating with increase in engine speed to safely avoid engine overload at higher engine speeds, but to also maintain a higher impeller rating to reduce the engine speed required closer to that of a propeller for a substantial lower portion of the vessel speed range. Hence, the selection of the flexibility (ie, less or more flexibility) of the trailing portions of the blades is a compromise between maintaining a high impeller rating with minimal progressive flex of the blade trailing portions over a significant portion of the engine speed range, and ensuring that the rating is sufficiently reduced by virtue of significant progressive flex of the blade trailing portions in an upper portion of the engine speed range to avoid engine overload.

In summary, the variable rating impeller substantially maintains a higher-than-conventional primary rating with minimal flex of the blades for a substantial portion of the lower engine speed range, for example when vessel speed demanded is between zero and cruise speed, but then begins to significantly reduce its rating with substantially more blade flex in the upper portion of the engine speed range, for example when the vessel speed demanded increases above cruise speed toward maximum speed. This variable rating impeller therefore reduces the engine speed required (compared to the conventional) across a substantial portion of the vessel speed range demanded due to its higher-than-conventional primary rating but also ensures reliable operation at higher vessel speeds by progressively reducing its rating to reduce risk of the engine overloading.

THEORY

The general theory underlying the progressive flex of the trailing portions of the blades of the impeller relative to the rotational speed of the impeller is set out in the following:

P=power absorbed by the waterjet

N=the rotational speed of the impeller in revolutions per minute

R=the impeller "rating", defined as the power absorbed by the impeller at a defined speed T=torque on the impeller F=blade loading force (a pressure field acting over an area of the blade, perpendicular to the blade surface)

δ=blade deflection (perpendicular to the blade trailing edge)

β=blade angle (with respect to the impeller axis)

For a waterjet (using α as meaning proportional to)

$P \alpha N^3$ $T \alpha P/N$, so therefore $T \alpha N^2$ $F \alpha T$ (the torque on the impeller is the summation of the blade loadings)

$\delta \alpha F$ (for a linear elastic material)

$\beta \alpha \delta$ (over small blade deflection angles)

$R \alpha \beta$ (over small blade deflection angles)

So in general terms, the rating R of the impeller is a function of the rotational speed N squared: $R \alpha N^2$ For a linear elastic material that is free to deflect under load, the blade deformation or degree of flex is proportional to $N^2$. Therefore, a linear elastic material at the trailing portions of the blades provides a progressively increasing reduction in the impeller rating as the engine speed increases.

EXAMPLE

Figure 1:
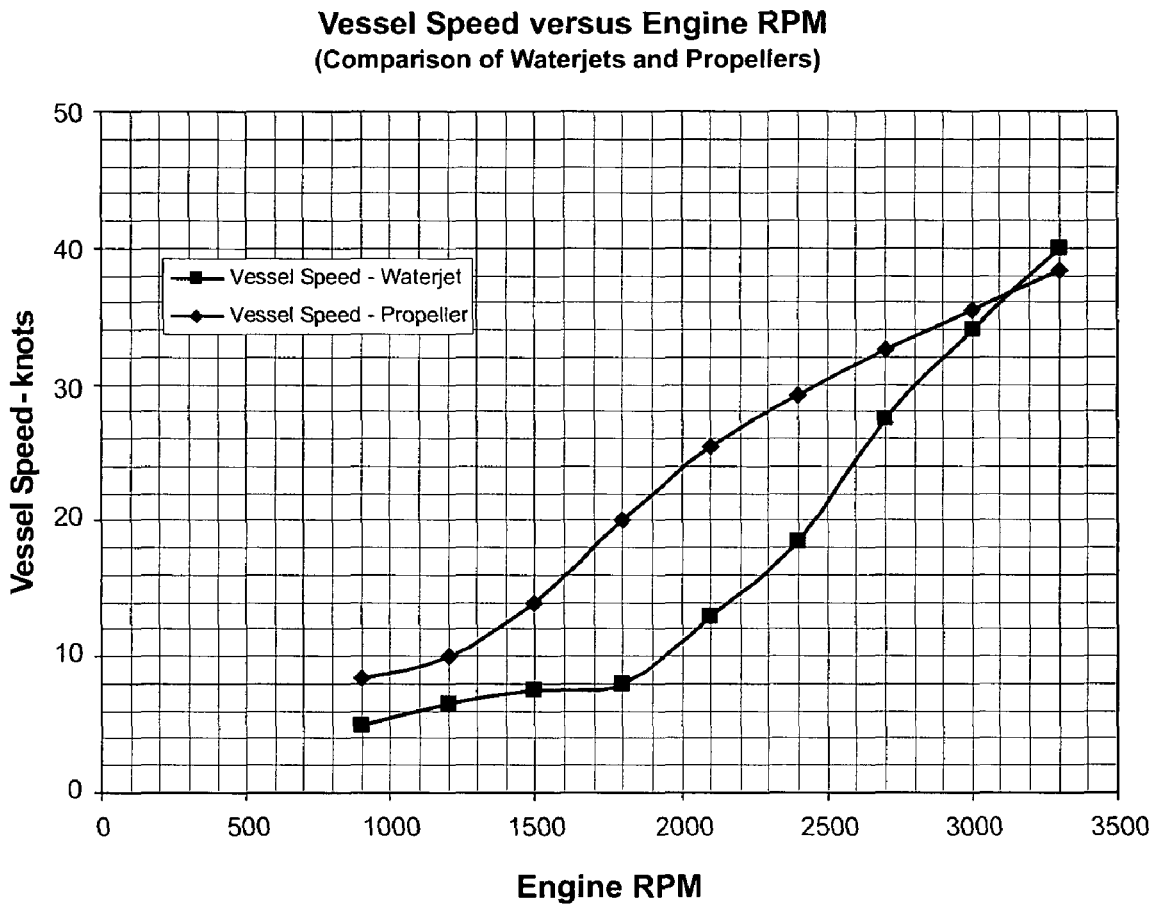
FIG. 1 shows a graph contrasting typical vessel speed versus engine speed characteristics for propeller and waterjet propulsion systems.

Referring to FIG. 1, for the difference in rpm to be addressed between propeller and waterjet propulsion systems, the impeller rating (R) of the waterjet propulsion system has to increase. For the case shown in FIG. 1, the rating would need to increase by around 40% at the cruise condition in order to absorb the same power at the 200 rpm lower engine speed of the propeller propulsion system. Referring to FIG. 2, in order to increase the rating of the impeller 10 by 40%, the water flow angle exiting the impeller blades 18 would need to increase by around 5-6 degrees and the blade angle would thus also have to increase by a similar amount.

Figure 3:
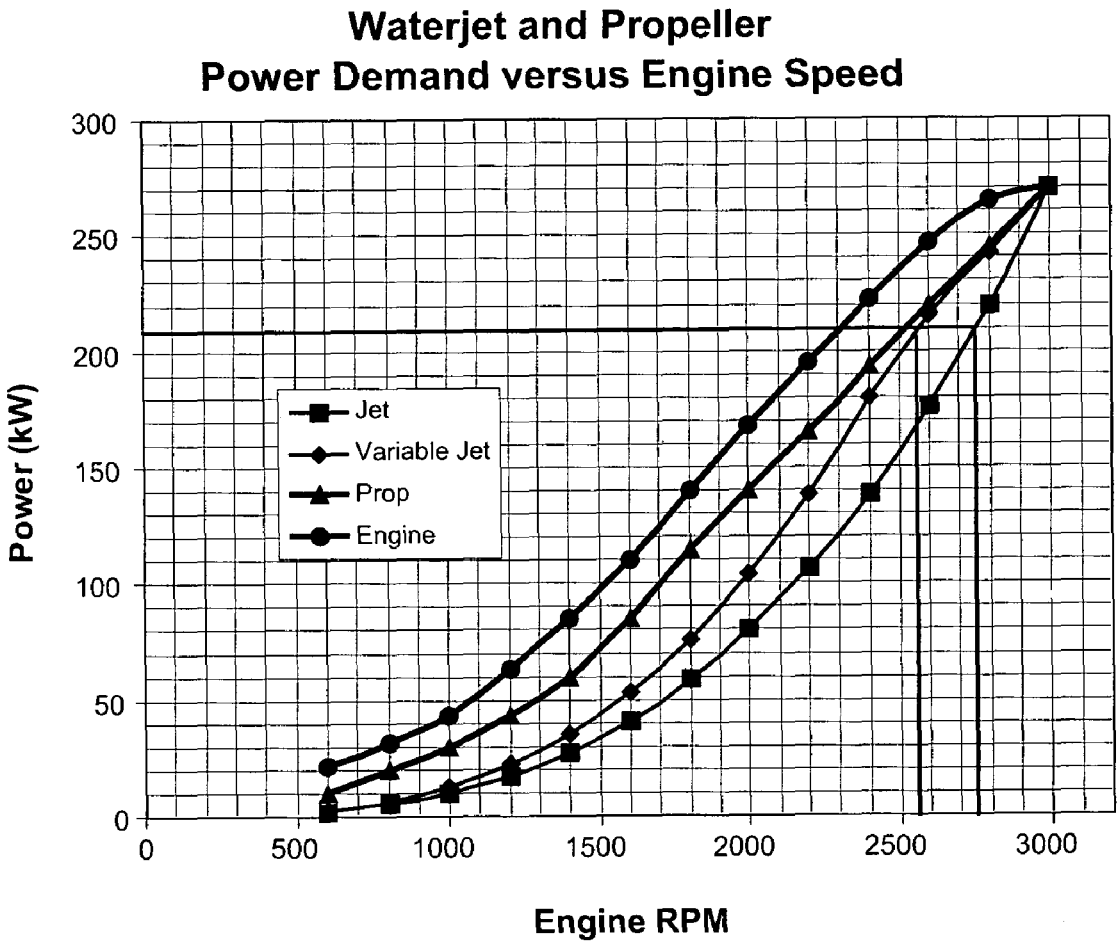
FIG. 3 shows a graph of power versus speed characteristics for a propeller propulsion system, a conventional waterjet propulsion system, and a waterjet propulsion system that employs an impeller of the present invention.

FIG. 3 shows an example of the power demand curve for a conventional waterjet impeller (refer "Jet" curve), with the maximum power delivery curve for a typical diesel engine superimposed (refer "Engine" curve) and the typical power demand curve for a propeller (ref "Prop" curve). The maximum rpm of the engine and waterjet is where the waterjet demand curve crosses the engine power delivery curve. In this case the engine power is 270 kW at maximum engine speed of 3000 rpm. As the engine throttle is reduced, the power delivered by the engine is governed solely by the waterjet demand curve.

FIG. 3 also shows the power demand curve for a waterjet having a variable rating impeller of the invention (refer "Variable Jet" curve), where the rating (R) progressively decreases from 14 kW at around 70% power input, to 10 kW at 100% power input. In this example the demand curve for the variable rating impeller follows closely the demand curve for the propeller (which is vessel dependent) in the upper part of the speed range from a typical cruise condition at approximately 75% power up to maximum speed condition at 100% power. Ignoring differences in propulsive efficiency between the waterjet and propeller at these two operating conditions, this would translate to a similar vessel speed versus rpm.

SUMMARY

The variable rating impeller substantially maintains a higher-than-conventional primary rating to reduce the engine speed required to propel a marine vessel at up to and including cruise speeds but is also arranged to progressively decrease its rating substantially at higher vessel speeds to ensure that the pump does not overload the engine of the waterjet unit. The principal benefits of the variable rating impeller is that it allows operators of waterjet propelled vessels to have a lower cruise rpm on the engines, which reduces noise and potentially allows the engine to operate at a slightly more efficient operating point. The present advantages of the waterjet are retained in that the power absorption characteristic is independent of vessel speed.

The foregoing description of the invention includes preferred forms thereof. Modifications may be made thereto without departing from the scope of the invention as defined by the accompanying claims.

The invention claimed is:

1. An impeller for the pump of a waterjet unit that is rotatably driven by an engine to generate a high velocity jet stream, having a thrust that is dependent on the power absorbed by the impeller, which is in turn dependent on the rating of the impeller and the engine speed, to propel a marine vessel, the impeller comprising:

a hub mountable to a rotating shaft through which an input power is transmitted by the engine; and a plurality of blades spaced about the periphery of the hub, the blades having a primary profile that defines the primary rating of the impeller, each blade having a span that extends outwardly from the hub to an outer edge of the blade and a length defined between a leading edge of the blade situated toward the front end of the hub and a trailing edge of the blade situated toward the rear end of the hub, where a trailing portion of each blade has resilient flexibility relative to the primary profile such that the trailing portion will progressively flex under hydrodynamic load to alter the profile of the blades to progressively lower the rating of the impeller with increase in engine speed, the flexible trailing portion of each blade having minimal progressive flex for a substantial portion of the lower engine speed range to maintain the primary rating of the impeller, and increasing substantial progressive flex for an upper portion of the engine speed range to progressively lower the rating of the impeller from its primary rating.

2. An impeller according to claim 1 wherein the trailing portions of the impeller blades are arranged to progressively flex under hydrodynamic load to alter the profile of the blades to progressively lower the rating of the impeller from the primary rating with an increase in engine speed, and then arranged to progressively increase the rating of the impeller back toward the primary rating as the engine speed decreases.

3. An impeller according to claim 1 wherein the flexible trailing portion of each blade extends approximately ⅓ or less of the length of the blade from the trailing edge.

4. An impeller according to claim 1 wherein the flexible trailing portion of each blade is arranged to flex toward a shallower profile relative to its primary profile to progressively lower the rating of the impeller with increase in engine speed.

5. An impeller according to claim 1 wherein the flexible trailing portion of each blade has a degree of flex that is proportional to the engine speed squared such that increasing engine speed causes a progressively increasing degree of flex on the trailing portions.

6. An impeller according to claim 1 wherein the flexible trailing portion of each blade is arranged to progressively flex from the primary profile to a maximum deflection angle in the upper portion of the engine speed range, the angle of deflection increasing at an increasing rate toward the maximum engine speed.

7. An impeller according to claim 1 wherein the primary profile of the blades is steeper than the conventional profile selected for the engine such that the impeller has a higher-than-conventional rating when the blades are resting in their primary profile.

8. An impeller according to claim 7 wherein the higher-than-conventional rating of the impeller is such that the primary profile of the blades provides a primary rating that, if maintained, would not allow the engine to reach its required operating speed for delivery of full power.

9. An impeller according to claim 1 wherein the number of blades spaced about the periphery of the hub ranges between four and six.

10. An impeller according to claim 1 wherein the flexible trailing portion of each blade is of a reduced thickness relative to remainder of the blade to provide for flex under hydrodynamic loads.

11. An impeller according to claim 1 wherein the blades are formed entirely from one type of material.

12. An impeller according to claim 1 wherein the blades are formed from a plurality of non-homogenous materials and wherein the flexible trailing portion of each blade is formed from a different material relative to the remainder of the blade to provide for flexibility under hydrodynamic loads.

13. An impeller according to claim 1 wherein each blade and its respective trailing portion is integrally formed as one component.

14. An impeller according to claim 1 wherein the flexible trailing portion of each blade is separately formed and attached to the remainder of its respective blade.

15. An impeller according to claim 1 wherein the blades are formed form a material selected from plastic or metal or any combination of these materials.

16. An impeller according to claim 1 wherein the primary profile of the blades provide a primary rating of the impeller that is higher than the conventional selected rating of the impeller for the engine to reduce the engine speed required compared to the conventional across a substantial portion of the vessel speed range demanded.

17. A waterjet unit for propelling a marine vessel comprising:

a pump having an intake for water;

an engine for driving the pump;

an impeller for the pump that is rotatably driven by the engine to generate a high velocity jet stream from the intake water, the high velocity jet stream having a thrust that is dependent on the power absorbed by the impeller, which is in turn dependent on the rating of the impeller and the engine speed, to propel the marine vessel, the impeller comprising:

a hub mountable to a rotating shaft through which an input power is transmitted by the engine; and a plurality of blades spaced about the periphery of the hub, the blades having a primary profile that defines the primary rating of the impeller, each blade having a span that extends outwardly from the hub to an outer edge of the blade and a length defined between a leading edge of the blade situated toward the front end of the hub and a trailing edge of the blade situated toward the rear end of the hub, where a trailing portion of each blade has resilient flexibility relative to the primary profile such that the trailing portion will progressively flex under hydrodynamic load to alter the profile of the blades to progressively lower the rating of the impeller with increase in engine speed, the flexible trailing portion of each blade having minimal progressive flex for a substantial portion of the lower engine speed range to maintain the primary rating of the impeller, and increasing substantial progressive flex for an upper portion of the engine speed range to progressively lower the rating of the impeller from its primary rating.

18. A waterjet unit according to claim 17 wherein the primary profile of the blades is steeper than the conventional profile selected for the engine such that the impeller has a higher-than-conventional rating when the blades are resting in their primary profile.

19. A waterjet unit according to claim 18 wherein the higher-than-conventional rating of the impeller is such that the primary profile of the blades provides a primary rating that, if maintained, would not allow the engine to reach its required operating speed for delivery of full power.

20. A variable rating impeller for the pump of a waterjet unit that is rotatably driven by an engine to generate a high velocity jet stream, having a thrust that is dependent on the power absorbed by the impeller, which is in turn dependent on the rating of the impeller and the engine speed, to propel a marine vessel, the impeller comprising:

a hub mountable to a rotating shaft through which an input power is transmitted by the engine; and a plurality of blades spaced about the periphery of the hub, the blades having a primary profile that provides a higher-than-conventional impeller primary rating for the engine, each blade having a span that extends outwardly from the hub to an outer edge of the blade and a length defined between a leading edge of the blade situated toward the front end of the hub and a trailing edge of the blade situated toward the rear end of the hub, where a trailing portion of each blade has resilient flexibility relative to the primary profile such that the trailing portion will progressively flex under hydrodynamic load to alter the profile of the blades to progressively lower the rating of the impeller with increase in engine speed, the degree of flex being minimal over a substantial lower portion of the engine speed range to provide a higher vessel speed in response to the engine speed relative to the conventional engine speed required by virtue of the higher-than-conventional impeller primary rating, and the degree of flex increasing substantially to lower the impeller rating as engine speed increases into an upper portion of the engine speed range to ensure the engine is not overloaded at higher engine speeds.

21. A variable rating impeller according to claim 20 wherein the higher-than-conventional rating of the impeller is such that the primary profile of the blades provides a primary rating that, if maintained, would not allow the engine to reach its required operating speed for delivery of full power.

22. A marine vessel comprising one or more waterjet units as claimed in claim 17.

23. A marine vessel comprising a waterjet unit having an impeller according to claim 1.

24. A marine vessel comprising a waterjet unit having an impeller according to claim 20.

* * * * *